US011441397B2

(12) United States Patent
Bodley

(10) Patent No.: US 11,441,397 B2
(45) Date of Patent: Sep. 13, 2022

(54) APPARATUS AND METHOD FOR LINING A BLAST HOLE

(71) Applicant: MTI GROUP PTY LTD, Western Australia (AU)

(72) Inventor: Nicholas Bodley, Western Australia (AU)

(73) Assignee: MTI GROUP PTY LTD, Wangara (AU)

( * ) Notice: Subject to any disclaimer, the term of this patent is extended or adjusted under 35 U.S.C. 154(b) by 267 days.

(21) Appl. No.: 16/303,120

(22) PCT Filed: Nov. 30, 2016

(86) PCT No.: PCT/AU2016/051177
§ 371 (c)(1),
(2) Date: Nov. 19, 2018

(87) PCT Pub. No.: WO2017/197427
PCT Pub. Date: Nov. 23, 2017

(65) Prior Publication Data

US 2020/0182022 A1 Jun. 11, 2020

(30) Foreign Application Priority Data

May 18, 2016 (AU) ..... 2016901856

(51) Int. Cl.
*E21B 43/10* (2006.01)
*F42D 1/10* (2006.01)

(52) U.S. Cl.
CPC ..... *E21B 43/10* (2013.01); *F42D 1/10* (2013.01)

(58) Field of Classification Search
CPC ..... E21B 43/10; F42D 1/10
See application file for complete search history.

(56) References Cited

U.S. PATENT DOCUMENTS 3,662,146 A * 5/1972 Vanderhelst ..... B23K 11/252 219/110
3,760,727 A 9/1973 Callister et al.
(Continued)

FOREIGN PATENT DOCUMENTS

GB 953490 A 3/1964
WO WO 2012/066585 A1 5/2012

OTHER PUBLICATIONS

International Search Report, dated Feb. 20, 2017 for corresponding International Application No. PCT/AU2016/051177.
(Continued)

*Primary Examiner* — Dany E Akakpo
(74) *Attorney, Agent, or Firm* — Intellectual Property Law Group LLP

(57) ABSTRACT

An apparatus for lining a blast hole comprises a tube of thermoplastic material and a welder for welding the tube, wherein an end of the tube can be welded closed by the welder and the desired length of tube can be dispensed and cut free from the rest of the tube when the closed end is at least part way inside the blast hole. There is also a method of lining a blast hole which comprises welding closed an end of a tube of thermoplastic material; placing the closed end in the blast hole and allowing it to descend into the hole; dispensing a desired length of tube; and cutting free the length of tube from the rest of the tube.

14 Claims, 2 Drawing Sheets

(56) References Cited

U.S. PATENT DOCUMENTS

| | | | | |
|---|---|---|---|---|
| 3,881,417 | A | 5/1975 | Mesia | |
| 4,019,438 | A | 4/1977 | Swanson | |
| 4,052,939 | A | 10/1977 | Simmons et al. | |
| 4,250,811 | A | 2/1981 | Mackey | |
| 4,448,010 | A | 5/1984 | Stohlquist et al. | |
| 6,377,189 | B1 * | 4/2002 | Newman | E21B 41/00 340/854.6 |
| 2002/0046548 | A1 | 4/2002 | Forman | |
| 2006/0005894 | A1 | 1/2006 | Rose et al. | |
| 2018/0371849 | A1 * | 12/2018 | Daton-Lovett | E21B 43/105 |

OTHER PUBLICATIONS

Written Opinion of the ISA, dated Feb. 20, 2017 for corresponding International Application No. PCT/AU2016/051177.

International Preliminary Report on Patentability completion date Apr. 18, 2018 for corresponding International Application No. PCT/AU2016/051177.

* cited by examiner

APPARATUS AND METHOD FOR LINING A BLAST HOLE

CROSS-REFERENCE TO RELATED APPLICATIONS

This application is a U.S. National Phase application, under 35 U.S.C. § 371, of International Application no. PCT/AU2016/051177, with an international filing date of Nov. 30, 2016, and claims benefit of Australian Application no. 2016901856 filed on May 18, 2016, which is hereby incorporated by reference for all purposes.

FIELD OF THE INVENTION

The present invention relates to an apparatus and method for lining a blast hole.

BACKGROUND

In the blasting industry, it is necessary to provide substantially watertight liners for use in many drilled blast holes in order to prevent water-sensitive explosives loaded into the blast holes from becoming wet. Due to the abrasive nature of the inside surface of the drilled blast holes and the process required to insert the liner into the holes (which can be up to 60 m deep), many traditional liners have been made of relatively thick, bulky and heavy plastics material (usually blown films of PP or PE). Such liners have prepared lengths (e.g. 20 m, 25 m, 30 m, 35 m, 40 m, etc.) and are provided with a pre-sealed pouch at one end. However, this approach often results in significant wastage as the length of all the liners ordered by the mine site would usually be to suit the deepest hole drilled, which may sometimes vary by as much as 10 m.

Abrasion resistant liners have been developed which are extremely strong in tensile strength and abrasion resistant. They are internally laminated for waterproofness and are far lighter than the conventional PP or PE liners discussed above. These liners are woven, with a combination of PP and PE strands in the weave (typically, PP runs in the vertical direction or warp and PE runs in the horizontal direction or weft). Because of current inability to weld these tubes because of the different melting points of the different polymers other techniques are used to close the end.

As demonstrated in FIG. 1, attempts to use cable ties (or the like) to "seal" the bottom of the liner have been made, but the seal provided by cable ties is rarely capable of preventing the ingress of moisture into the end of the liner. Cable ties can also sometimes be dislodged from the end of the tube during its insertion into the blast hole, potentially resulting in spillage of the explosive from the liner, as well as water ingress into the liner, with a consequent detrimental effect to its explosive properties. Unfortunately this technique also does not produce a good watertight seal.

It would be advantageous to be able to line a blast hole without waste of liner material and with a good watertight seal.

Any references to documents that are made in this specification are not intended to be an admission that the information contained in those documents form part of the common general knowledge known to a person skilled in the field of the invention, unless explicitly stated as such.

SUMMARY OF THE INVENTION

According to a first aspect, the present invention provides an apparatus for lining a blast hole comprising a tube of thermoplastic material and a welder for welding the tube, wherein an end of the tube can be welded closed by the welder and the desired length of tube can be dispensed and cut free from the rest of the tube when the closed end is at least part way inside the blast hole.

In an embodiment the tube is held in a dispenser.

In an embodiment the welder applies a heat to the tube in pulses so as to weld the tube closed.

In an embodiment the apparatus is portable. In an embodiment the apparatus is mounted on a vehicle.

In an embodiment the welder comprises a cutter for cutting the free end from the rest of the tube.

According to a second aspect, the present invention provides a method of lining a blast hole comprising welding closed an end of a tube of thermoplastic material; placing the closed end in the blast hole and allowing it to descend into the hole; dispensing the desired length of tube; and cutting free the length of tube from the rest of the tube.

In an embodiment the method further comprises moving to the next blast hole and repeating the process for the next blast hole.

In an embodiment the welding closed of the end of the tube is conducted while in transit to the next blast hole.

As used herein, the term "composite thermoplastic material" is to be understood to mean a thermoplastic material that includes discrete portions of different polymers. The different polymers are not blended in the material and substantially retain their own physical and chemical properties (i.e. a polymer blend is not formed to any significant degree). In some embodiments, the composite thermoplastic materials may comprise woven strands (e.g. threads or filaments) of discrete polymer components, woven into substantially planar sheets, for example. In some embodiments, the composite thermoplastic materials may comprise (or further comprise) an internal and/or external laminate layer (e.g. to improve the durability or waterproofing of the material). Such a laminate layer may, for example, be made from a different polymer than that of those used to form the remainder of the composite thermoplastic material.

In this specification the terms "comprising" or "comprises" are used inclusively and not exclusively or exhaustively.

BRIEF DESCRIPTION OF THE DRAWINGS

In order to provide a better understanding of the present invention embodiments will be described in further detail below with reference to the accompanying drawings, in which.

DETAILED DESCRIPTION

The present invention provides an apparatus and method for lining blast holes with a liner tube formed of composite thermoplastic materials and having a welded closed end.

Figure 1:
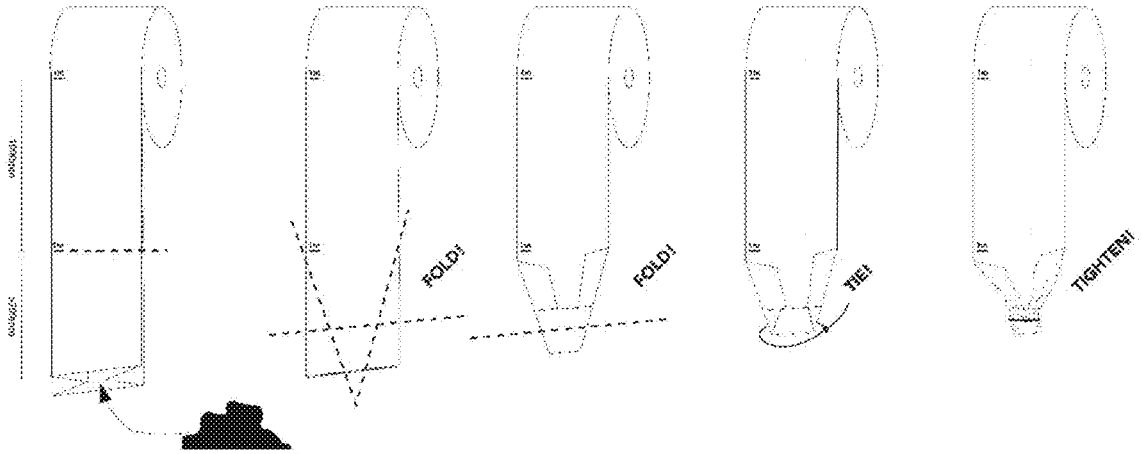
Figure 1 (Prior Art)
FIG. 1 is a schematic set of diagrams of a prior art process of sealing a gusseted plastic tube for insertion into a blast hole.
Figure 2:
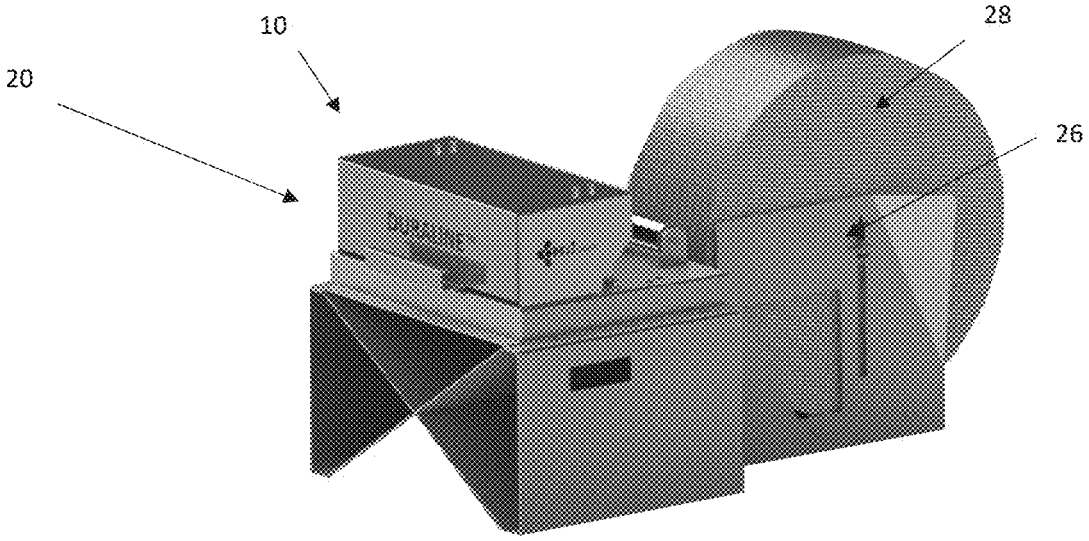
FIG. 2 is a perspective view of a welding apparatus for sealing an end of a gusseted plastic tube held in a spool.
Figure 3:
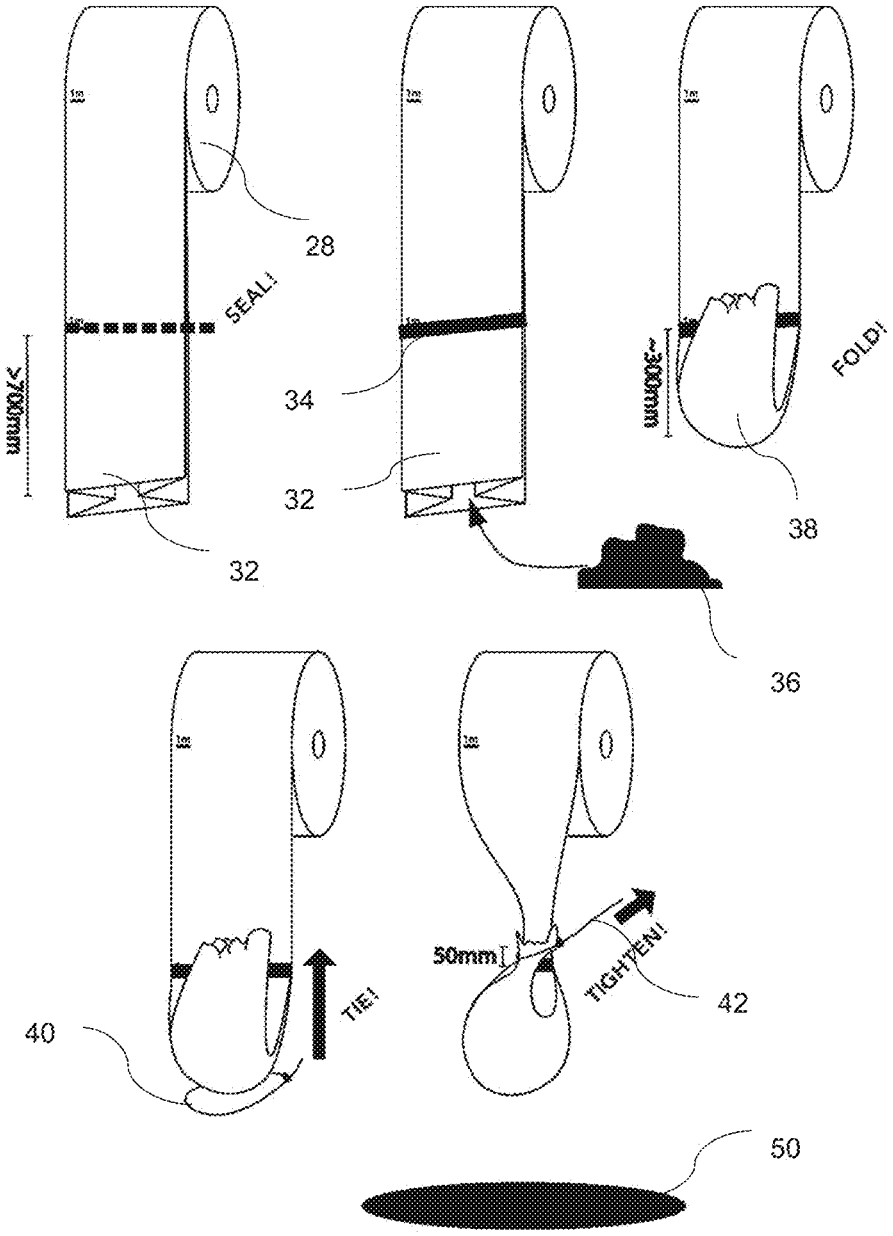
FIG. 3 shows a schematic set of diagrams showing a method of sealing the gusseted tube with the apparatus of FIG. 2 for insertion into a blast hole.

Referring to FIG. 2, a welder 10 is shown having a lid 20 and a dispenser 26, which contains a roll of gusseted tube 28 (see also FIG. 3). The dispenser 26 can freely rotate in order for the gusseted tube 28 to be readily dispensed when pulled.

The dispenser 26 is positioned on the welder 10 such that the dispensed portion of the gusseted tube 28 can be fed through the upper 12 and lower 14 clamping members (and hence welded, as described below). The dispenser 26 enables bulk tube dispensing and roll on loading in order to reduce manual handling. Typically the welder 10 will be mounted to a vehicle. Typically this will be on the side of a tray of a utility vehicle.

Referring to FIG. 3, there is shown a roll 28 of the gusseted tube of composite thermoplastic tube. For clarity the welder 10 is not shown. The tube has an open end 32. The thermoplastic materials may be present in the composite thermoplastic materials in any suitable discrete form. In some embodiments, the composite thermoplastic materials may, for example, be discrete polymer layers of a laminate material. In some embodiments, the composite thermoplastic materials may be in the form of strands of discrete polymers which are, for example, woven into substantially planar sheets. For example, as will be discussed in further detail below, tubular sheets having a combination of PP and PE strands in the weave (typically the PP runs in the vertical direction or warp and PE runs in the horizontal direction or weft) have been found to have advantageous properties. In particular, the PP warp offers minimal stretch and excellent abrasion resistance as well as improved environmental factors, whereas the PE weft is present to bind everything together and provides a better hermetic seal. As would be appreciated, sheets made from woven materials would be more tear resistant than many other forms of construction.

Such tubes may also have an internal (or external) laminate in order to provide additional advantageous properties (e.g. waterproofing or air resistance). In such cases, a laminate having a similar polymer to that present in the (woven) parent materials might help to improve the weld because the internal lamination is likely to bind better and, during welding, the heat transfer is improved and the heated plastic flows better, binding the parent materials and laminate together with greater mechanical strength. This means that the barrier created by the weld between the outside of the bag and the inside of the bag can be vastly superior to that provided by conventional welding techniques.

Sufficient free tube is dispensed. In this example at least 700 mm (typically about 1 m) of free tube is dispensed. At a desired length the tube is sealed by welding with the welder 10. In order to weld the composite thermoplastic a new welding technique is used by the welder 10 which entails pulsed heating to form the weld 34. The weld 34 forms a moisture barrier.

A weight 36 is inserted into the open end 33 of the tube 32. Typically the weight 36 is borehole cuttings (dirt). The free end is then folded over the weld 34 as indicated by 38. The folded end is about 300 mm from the weld 34 as shown.

A cable tie 40 is then slipped over the folded end in the vicinity of the weld 34, but preferably about 50 mm above the weld 34 at 42 and tightened. The cable tie 40 maintains the weight inside the end portion of the tube and also prevents the initial load of explosives from rupturing the weld 34.

The weight 36 is used to weigh the tube down to assist it in lowering into the borehole 50. The tube is then rolled off the dispenser 26 until the weight reached the bottom, or the desired depth.

The length can be cut from the dispenser and filled with explosive with at least 700 mm of free end from the welder jaws. However generally this will occur sometime later. In one option the end can be welded sealed until it is needed to be filled with explosive, however this may not be necessary. The tube can be secured above the opening 50 to the blast hole with a spike or by use of a stand in the blast hole. The operator can then move on to the next bore hole to be lined. The operator may close the jaws on the material to weld closed the end so that by the time the operator arrives at the next hole the material 28 is sealed and ready to receive the weight, which saves time. When needed, the opening of the tube inside the blast hole can be filled with explosive so as to fill the blast hole, with the tube acting as a liner of the blast hole.

It will be appreciated by those skilled in the art that variations and modifications to the embodiments of the invention described herein will be apparent without departing from the spirit and scope thereof. The variations and modifications as would be apparent to persons skilled in the art are deemed to fall within the broad scope and ambit of the invention as herein set forth.

The invention claimed is:

1. An apparatus for lining a blast hole comprising a tube of thermoplastic material and a portable thermoplastic welder; wherein the tube is held in a dispenser, wherein the tube is in a substantially continuous cylindrical form prior to being dispensed from the dispenser, wherein the welder is configured to weld the tube transverse to a length of the tube, wherein when the welder is operated an end of the tube is welded closed transversely to the length of the tube by the welder, wherein a desired amount of the length of tube required for the blast hole at the site of the blast hole is able to be dispensed from the dispenser, wherein the dispensed substantially continuous cylindrical tube is able to be cut free from the rest of the tube when the closed end is at least part way inside the blast hole.

2. An apparatus for lining a blast hole according to claim 1, wherein the welder applies a heat to the tube in pulses by contact with the tube so as to weld the end of the tube closed.

3. An apparatus for lining a blast hole according to claim 1, wherein the apparatus is portable.

4. An apparatus for lining a blast hole according to claim 1, wherein the apparatus is mounted on a vehicle.

5. An apparatus for lining a blast hole according to claim 4, wherein the welder comprises a timer for turning off welding heat applied to the tube for welding closed the end after a set period of time.

6. An apparatus for lining a blast hole according to claim 5, wherein the welder is operable to weld closed of the end of the tube while in transit until the timer turns off the welding heat.

7. An apparatus for lining a blast hole according to claim 1, wherein the welder comprises a cutter for cutting a free end from the rest of the tube.

8. An apparatus for lining a blast hole according to claim 1, wherein when the tube is filled with explosive the weld holds the explosive inside of the tube, and the weld prevents ground water from entering the tube when the weld is in the blast hole.

9. A method of lining a blast hole comprising:

providing a dispenser holding a tube of thermoplastic material which is in a substantially continuous cylindrical form prior to being dispensed from the dispenser;

welding closed an end of the tube of thermoplastic material on-site, wherein the weld is transverse to a length of the tube;

placing the closed end in the blast hole and allowing it to descend into the hole;

dispensing a desired amount of the length of tube required for the blast hole from the dispenser; and cutting free the desired amount of the length of tube from the rest of the tube.

10. A method of lining a blast hole according to claim 9, wherein the method further comprises moving to another blast hole and repeating the method for the other blast hole.

11. A method of lining a blast hole according to claim 9, wherein the method further comprises welding closed a cut end of a surface remainder of the tube on-site for use in a next blast hole.

12. A method of lining a blast hole according to claim 11, wherein the welding closed of the end of the tube is conducted while in transit to the next blast hole.

13. A method of lining a blast hole according to claim 12, further comprising operating a timer for determining when to turn off welding heat applied to the tube for welding closed the end while in transit.

14. A method of lining a blast hole according to claim 9, wherein when the tube is filled with explosive the weld holds the explosive inside of the tube, and the weld prevents ground water from entering the tube when the weld is within the blast hole.

* * * * *